US009074843B1

(12) United States Patent
Montgomery

(10) Patent No.: US 9,074,843 B1
(45) Date of Patent: Jul. 7, 2015

(54) PAYLOAD DELIVERY DEVICE

(71) Applicant: Jerry R Montgomery, West Jordan, UT (US)

(72) Inventor: Jerry R Montgomery, West Jordan, UT (US)

( * ) Notice: Subject to any disclaimer, the term of this patent is extended or adjusted under 35 U.S.C. 154(b) by 253 days.

(21) Appl. No.: 13/645,631

(22) Filed: Oct. 5, 2012

(51) Int. Cl.
*F41F 3/04* (2006.01)
*F41F 1/06* (2006.01)

(52) U.S. Cl.
CPC ..... *F41F 1/06* (2013.01)

(58) Field of Classification Search
USPC ..... 89/1.816, 1.41, 1.3, 1.815
See application file for complete search history.

(56) References Cited

U.S. PATENT DOCUMENTS

| | | | | | |
|---|---|---|---|---|---|
| 45,623 | A | * | 12/1864 | Natcher | 89/1.41 |
| 282,787 | A | * | 8/1883 | Shields | 89/1.41 |
| 1,340,111 | A | * | 5/1920 | Bonali | 89/37.02 |
| 1,448,587 | A | * | 3/1923 | Arntzen | 89/1.41 |
| 2,181,819 | A | * | 11/1939 | Radelet et al. | 89/37.02 |
| 2,866,384 | A | * | 12/1958 | Hersh | 89/1.3 |
| 2,925,012 | A | | 2/1960 | Malloy et al. | |
| 3,068,755 | A | * | 12/1962 | Johnstone et al. | 89/1.3 |
| 3,534,653 | A | * | 10/1970 | Specht et al. | 89/1.815 |
| 3,643,545 | A | * | 2/1972 | Nahas | 89/1.3 |
| 3,708,563 | A | * | 1/1973 | Sells | 264/46.5 |
| 3,804,021 | A | | 4/1974 | McGirr | |
| 3,818,794 | A | * | 6/1974 | Mayer et al. | 89/40.03 |
| 4,222,306 | A | * | 9/1980 | Maury | 89/1.41 |
| 4,233,882 | A | * | 11/1980 | Eichweber | 89/1.41 |
| 4,882,974 | A | * | 11/1989 | Reuter et al. | 89/41.16 |
| 5,020,437 | A | | 6/1991 | Rieger et al. | |
| 5,269,214 | A | * | 12/1993 | Badura et al. | 89/1.41 |
| 5,415,152 | A | | 5/1995 | Adamson et al. | |
| 5,429,053 | A | * | 7/1995 | Walker | 102/342 |
| 5,452,640 | A | * | 9/1995 | Bovee et al. | 89/1.815 |
| 6,311,681 | B1 | * | 11/2001 | Snyder, Jr. | 124/59 |
| 6,393,990 | B1 | | 5/2002 | Fagan | |
| 6,860,187 | B2 | * | 3/2005 | O'Dwyer | 89/127 |
| 7,007,584 | B2 | * | 3/2006 | Caballer Barat | 89/1.816 |
| 7,237,468 | B2 | * | 7/2007 | Laine | 89/37.05 |
| 7,293,492 | B2 | * | 11/2007 | Brunn | 89/1.807 |
| 7,313,995 | B2 | * | 1/2008 | Shah et al. | 89/1.815 |
| 7,631,600 | B2 | * | 12/2009 | O'Dwyer | 102/438 |
| 8,490,532 | B2 | * | 7/2013 | Barlow et al. | 89/1.41 |
| 8,536,500 | B2 | * | 9/2013 | Glasson | 244/3.1 |
| 8,701,538 | B2 | * | 4/2014 | Marscher et al. | 89/1.11 |
| 2001/0015126 | A1 | * | 8/2001 | Grunewald | 89/1.41 |
| 2003/0010185 | A1 | | 1/2003 | O'Dwyer | |
| 2003/0051597 | A1 | | 3/2003 | O'Dwyer | |
| 2006/0288857 | A1 | * | 12/2006 | Laine | 89/37.05 |
| 2008/0006168 | A1 | * | 1/2008 | Huang | 102/358 |
| 2008/0276820 | A1 | | 11/2008 | Huang | |
| 2011/0030541 | A1 | * | 2/2011 | Barlow et al. | 89/1.41 |
| 2014/0076133 | A1 | * | 3/2014 | Brill et al. | 89/1.41 |

* cited by examiner

*Primary Examiner* — Michelle R Clement
(74) *Attorney, Agent, or Firm* — JP Webb; Jason P. Webb; Danny Y. H. Cheng

(57) ABSTRACT

There is a payload delivery device and system configured for projectile dispersion over a defined area. The device includes a launching platform configured to provide structural support. The device also includes a two-dimensional array of launching guides extending upwardly from the launching platform. Each launching guide of the array is fixed at a specific inclination angle and at a specific horizontal direction angle. The device includes a plurality of vessels functionally connected to the array of launching guides and is configured to launch therefrom. The launching platform includes a symbolic indicator associated with an operational characteristic of the device. The launching platform includes a mating structure configured to mate to another similar launching platform.

16 Claims, 6 Drawing Sheets

PAYLOAD DELIVERY DEVICE

BACKGROUND OF THE INVENTION

1. Field of the Invention

The present invention relates to a launching device, specifically to a payload delivery device and system.

2. Description of the Related Art

A mortar is an indirect fire weapon that fires explosive projectiles known as mortar bombs at low velocities, short ranges, and high-arcing ballistic trajectories. It is typically muzzle-loading and generally has a barrel length less than 15 times its caliber. A mortar is relatively simple and easy to operate. A modern mortar consists of a tube into which assistant gunners drop a purpose-designed bomb. The tube is generally set at between 45 and 85 degrees angle to the ground, with the higher angle giving shorter firing distances. The bomb generally has no cartridge case; the propellant is attached to the bomb's fins. When it reaches the base of the tube it hits a firing pin, which detonates the propellant and fires the projectile. Some larger caliber mortars have a string-operated firing pin.

Light and medium mortars are portable, and usually used by infantry units. The chief advantage a mortar section has over an artillery battery is the flexibility of small numbers, mobility and the ability to engage targets in the defilade with plunging fires. Mortars are able to fire from the protection of a trench or defilade. In these aspects, the mortar is an excellent infantry support weapon, as it can be transported over any terrain and is not burdened by the logistical support needed for artillery. Heavy mortars are typically between 120- and 300-mm calibre. These weapons are usually towed or vehicle-mounted, sometimes breech-loaded, and normally employed by infantry units attached to battalion through division level. Even at this size, mortars are simpler and less expensive than comparable howitzers or field guns.

A mortar can be carried by one or more people (larger mortars can usually be broken down into components), or transported in a vehicle. An infantry mortar can usually also be mounted and fired from a mortar-carrier, a purpose-built or modified armoured vehicle with a large roof-hatch. A mortar can also be a launcher for fireworks, a hand-held or vehicle-mounted projector for smoke shells or flares, or a large grenade launcher. Heavy mortars can be mounted on a towed carriage, or permanently vehicle-mounted as a self-propelled mortar. Twin-barrelled self-loading mortars—such as the Patria AMOS PT1—are the latest evolution of these heavy mortars and are mounted on platforms such as armoured personnel carriers, tank chassis, and coastal patrol boats.

Another defensive/offensive device is a claymore mine, which is a directional anti-personnel mine that provides a directed area attack by use of a shaped explosive adjacent to an array of metal balls. The claymore mine is generally effective out to about 50-100 meters within a 60 degree arc in front of the mine. It is hazardous to be adjacent to the mine when it explodes. Coverage beyond 100 meters is generally not effective and the shape covered is that of a semi-circular wedge.

Some improvements have been made in the field. Examples of references related to the present invention are described below in their own words, and the supporting teachings of each reference are incorporated by reference herein:

U.S. Pat. No. 6,393,990, issued to Fagan, discloses a firing launching system and method which comprises a base having a plurality of apertures. The plurality of apertures receive a plurality of mortars which, in turn, receive a plurality of Pyrotechnic projectiles which may be situated in the plurality of mortars, respectively. The Pyrotechnic projectiles may then be ignited and launched to provide a fireworks display.

The base may be a one-piece molded solid construction and provided with the plurality of apertures such that at least two-thirds of each of the plurality of mortars is encased to provide support to a wall of the mortar. The base may be provided with a plurality of apertures having a common diameter for receiving a common size mortar or receiving one of a plurality of sleeves, each having the same outer diameter, but a varying inner diameter to permit the sleeve to receive a different sized mortars. In alternate embodiments, the base may be provided hollow such that it can be filled with an insulator, such as water or sand, at a launch site. In this embodiment, the base can be emptied to facilitate transporting the base to and from the pyrotechnic launch site.

U.S. Pat. No. 5,429,053, issued to Walker, discloses a pyrotechnic fan rack for mounting a plurality of individual fireworks pieces in a fanned array. The rack has an elongated body with an arcuate top profile and a flat base. Mounting ears are formed on the base to secure the rack to a surface. A series of sockets are formed through the top wall of the body along the horizontal length of the body. Each socket is formed in the body with its axis in preselected fixed angle relative to the axis of adjacent sockets. Tubes containing fireworks pieces are mounted in the sockets and extend out of the holes with their discharge ends in a desired angular relationship to adjacent firework pieces. A fuse groove seating an ignitable instantaneous fuse is formed along a horizontal length of the body connecting each of the sockets.

U.S. Pat. No. 5,415,152, issued to Adamson et al., discloses a method of successively launching a plurality of projectiles, such as fireworks projectiles, which explode into an aerial pyrotechnic display. The projectiles are launched from a launcher having a pressure tank containing a compressed gas and a plurality of launching tubes for holding the projectiles. The launching tubes are constructed to form a magazine to enable successive launching of fireworks projectiles by appropriate indexing of the magazine which brings the launching tubes into registration with the output port of a valve. The valve introduces compressed gas into one of the launching tubes to launch a projectile into the air. Indexing of the launching tubes when the pressure tank is pressurized prior to launch is prevented by a stop mechanism. The stop mechanism also prevents inadvertent or accidental detonation of the projectile in the launching tube. The method further includes the step of aiming the projectiles, preferably with an aiming apparatus comprising actuators that support the launcher and which are adjustable to change the launching angle of the launcher with respect to the ground each time a new launching tube is indexed to a launching position. The adjustment of these actuators is controlled by pneumatic switches that are operated during indexing of the launching tubes.

U.S. Pat. No. 5,020,437, issued to Rieger et al., discloses a plurality of separate projectiles is held together in a multiple shell or cluster shell, in the form of a stack. At least two parallel springy flat bands (7) extend lengthwise around the stack. The flat bands (7) are looped around the front end and the free band ends engage the rare end of the stack with hooks (9). A tensioning element engages and holds the hooks (9) and thus the bands (7) tightly to the stack. After the shell is fired the tensioning element is served, e.g. by a cutter (19) so that the flat bands (7) spring or flare open to release and distribute the separate projectiles. The release means is equipped to either cause release immediately after the shell has left the firing tube (4) or with a delay. A front end plate (16) and a rear end plate (17) may be arranged at the ends of the stack.

Intermediate plates (26) may be arranged between adjacent projectiles. Parachutes may be provided to pull the separate projectiles from the shell stack in sequence as the projectile bodies are released by the flat springy bands in order to realize with the separate projectile bodies various desired impact scatter or cluster patterns on ground.

U.S. Patent Application Publication No.: 2008/0276820, by Huang, discloses a styling pyrotechnic device comprising multiple, two preferred, bearing members with each disposed with multiple locating holes to receive insertion of multiple pyrotechnic tubes; each pyrotechnic tube being erected at a certain inclination; multiple locating holes on each bearing member being arranged in a circle; each circle having its circumference same as or different from that of another circle for multiple pyrotechnic tubes to be erected at different inclinations to produce various styling effects when fired into the skies.

The inventions heretofore known suffer from a number of disadvantages which include being difficult to use, being inaccurate, being limited in use, being limited in range, being limited in adaptability, being limited in payload variety, being difficult to control, being difficult to aim, being unduly complex, being expensive, not being disposable, failing to cover a desired region, failing to cover a desired-shaped region, requiring the operator to stand a great distance from the device during operation, being dangerous to operate especially in the proximity of the device, failing to appropriately distribute payload over a region, causing undesired overlapping/clumping of coverage of a region, causing gaps in coverage over a region, failing to provide for crowd dispersal, failing to cover a sufficient region, failing to provide area denial, and the like and combinations thereof.

What is needed is a delivery payload device and system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available payload delivery devices and systems. Accordingly, the present invention has been developed to provide an accurate and effective payload delivery device and system.

According to one embodiment of the invention there is a payload delivery device and system configured for projectile dispersion over a defined area. The device may include a launching platform that may be configured to provide structural support. The device may also include a two-dimensional array of launching guides that may be extending upwardly from the launching platform. Each launching guide of the array may be fixed at a specific inclination angle and at a specific horizontal direction angle. Each launching guide of the array may be fixed at a combination of inclination angle and horizontal direction angle that may be unique among the launching guides of the array. The device may include a plurality of vessels that may be functionally connected to the array of launching guides and may be configured to launch therefrom.

The horizontal direction angle of each of the launching guides may be a function of a distance of the launching guide from an edge of the launching platform. The inclination angle of each of the launching guides may be a function of a distance of the launching guide from an edge of the launching platform. The inclination angle and the horizontal direction angle of each of the launching guides may be predetermined to generate a substantially even distribution of projectile dispersion over a predetermined shape area. The device may further include an angle adjustment mechanism that may be coupled to the launching platform and may be in communication with the two dimensional array of launching guides, and may be configured to adjust a horizontal direction angle and an inclination angle of the two dimensional array of launching guides, in predefined increments.

The launching platform may include a symbolic indicator associated with an operational characteristic of the device. The symbolic indicator may include an operational characteristic selected from the group of operational characteristics consisting of: range, shape area, density, depth, width, length, and diameter. The launching platform may include a mating structure that may be configured to mate to another similar launching platform. The plurality of vessels may include a payload selected from the group of payloads consisting of: explosives, smoke generation agents, and irritant (chemical) agents.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
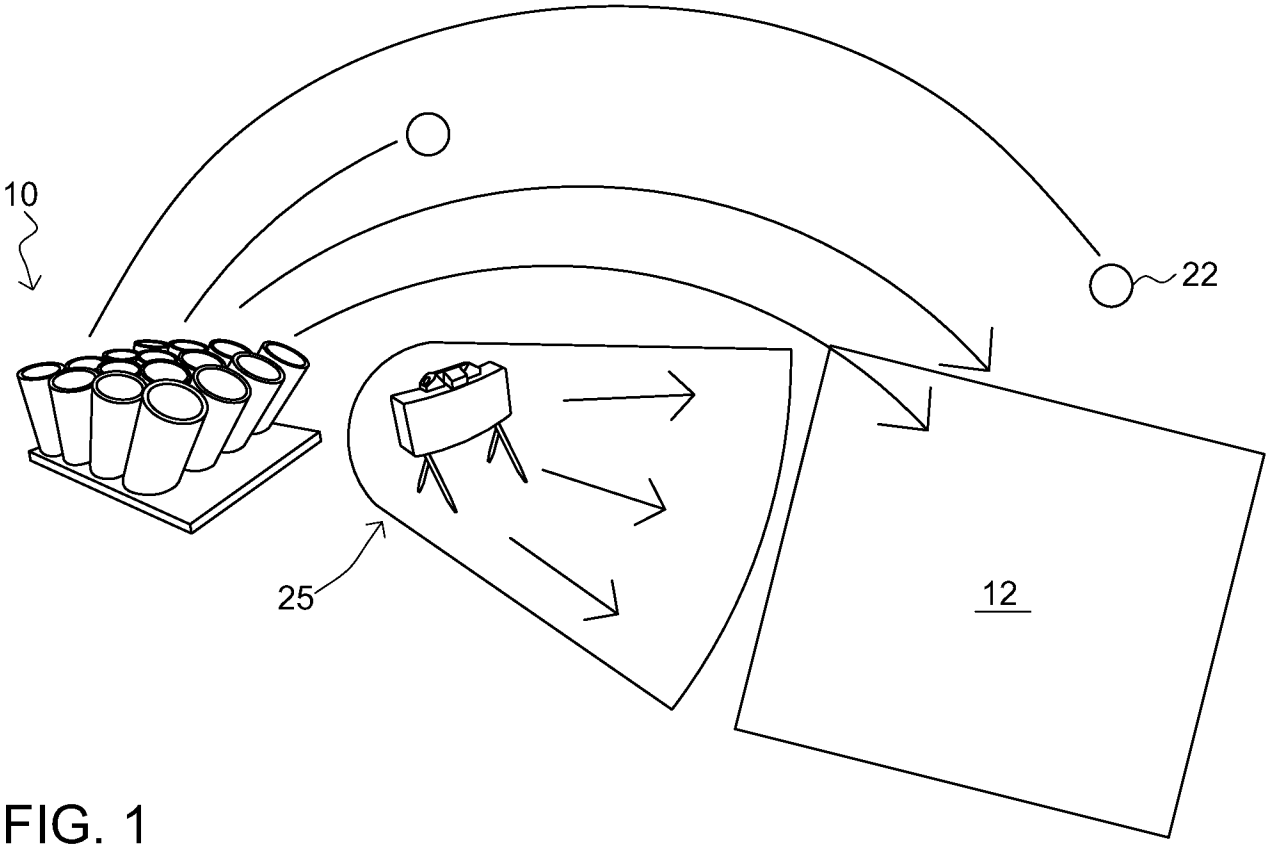
FIG. 1 is a perspective view of a payload delivery system including a payload delivery device used in conjunction with a claymore mine, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a payload delivery system including a payload delivery device used in conjunction with a claymore mine, according to one embodiment of the invention. There is shown a payload delivery device 10 launching a plurality of vessels 22 over a defined area 12. The payload delivery device is proximate to a claymore defense system 25 configured to provide near-range defense of a region in front of the claymore defense system.

The illustrated payload delivery device 10 is configured for projectile dispersion over a defined area 12. The payload delivery device 10 may be configured in a military or police use such as, but not limited to, to launch mortars, explosives, ammunition, etc. or in a commercial use such as, but not limited to, to launching items, gifts, promotional products, fireworks, etc. Wherein the device is used in conjunction with a claymore system, the use is almost exclusively lethal military use.

The device 10 includes a plurality of vessels 22 that are functionally connected to the device 10 and are configured to launch therefrom. The plurality of vessels 22 may encase a mortar or an explosive configured to be launched from the device 10 and explode aerially above the defined area 12. The plurality of vessels 22 may encase a gift or promotional item, such as a T-shirt, configured to be launched from the device 10 to the defined area 12. The plurality of vessels 22 may include a payload selected from the group of payloads consisting of: explosives, smoke generation agents, and irritant (chemical) agents.

The illustrated payload delivery device 10 is configured to provide a projectile dispersion over a defined area 12. Typically, in military use, a claymore mine 25 is used to provide a projectile dispersion over an area. However, the illustrated claymore mine 25 covers a minimal area compared to the defined area 12 of the payload delivery device 10. In addition, the claymore mine 25 is more difficult to control and operate compared to the payload delivery device 10.

Such a device will generally include one or more triggering/detonation devices/structures/systems that may be operated manually, remotely, activated by enemy combatants, by electronic or other signal, and/or etc. The following are non-limiting examples of such devices/structures/systems and the supporting teachings of such are incorporated herein, U.S. Pat. No. 5,327,835, issued to Adams et al.; or U.S. Pat. No. 5,610,361, issued to Vernet et al.; or U.S. Pat. No. 7,301,750, issued to DeVries et al.

In one non-limiting example, there is an aerial denial device which simultaneously launches a plurality of vessels. Such vessels may contain a variety of payloads/armaments, into a predefined array either killing, injuring, or dispersing the occupants of the area that the array strikes. The device may include a launching platform containing an array of short launching guides (such, as but not limited to, mortar tubes) with each one set at a predefined angle that may be unique/diverse when compared to angles of other guides of the device. This design enables the launched vessels to cover the pre-designed area. Such a pre-designed area may be illustrated on the device and/or specific thereon such that operators of the device may be able to predict distribution of the vessels at launch. The vessels may include non-lethal components and/or lethal components for total aerial denial in a military scenario. Wherein aerial discharge is desired, the vessels may be configured to discharge their cargo within a vertical range above the ground, such as but not limited to between about 5-10 meters above the ground. Such may be controlled via timing, fusing, proximity detection, and the like and combinations thereof. Exemplary cargo may include, but is not limited to, pellets, shrapnel, skunk oil, pepper, tear-gas, flash-bangs, marking paint, ceramic shoot, rubber beads, t-shirts, candy, smoke generators, dyes, toys, prizes, confetti, ticker tape, powered LEDs, fireworks, and/or anything that will produce the desired effect, and/or combinations thereof. Cargo may be explosively distributed by use of a fused/timed/etc. explosive within the vessel. Match and fuse systems may be double or triple redundant as desired. Generally, disbursed vessels are ejected from the launch platform using small launching charges. Control of the launch pattern can be determined by the position of the launching charge, or the distribution of vessels internally within the launcher, and/or the distribution of launching charges, in conjunction with other internal launching structure such as rails, tubes, and/or physical structures designed to direct and form a distribution pattern. This will place or project the explosive cargo vessels into a designed and/or engineered, planned area, designated zone, or pre-prescribed location, all in a predetermined formation. The device may be triggered manually or automatically and may be integrated with other defense systems. Vessels may include fins, drogues, or may use other directional control device to orient the explosive vessels prior to detonation to effect a directional operation of the cargo being delivered. Oriented vessels may be filled or composed of an explosive that fires shot like a shotgun in a predetermined direction. Oriented vessels may contain a shape charge and/or may contain penetrators surrounded by shot or shrapnel. Oriented vessels may contain a hemispherical charge containing multiple soft-metal (copper, zinc, aluminum, etc.) lined cones. Such may form multiple downward directed penetrators over a pre-designed area below the detonated cargo vessel.

In still another non-limiting embodiment, there is a device that consists of or consists essentially of a launching platform having an array of launch guides extending therefrom. Such a device may include one or more of the variations, features, structures, relationships and/or etc. as described herein and/or may exclude one or more of the variations, features, structures, relationships and/or etc. as described herein. There may be a system that consists of, consists essentially of, or includes one or more such devices.

Advantageously, wherein a low amount of propellant is used to launch the vessels, a user/operator of a system/device as described herein may be proximate the device during launch without likely damage/injury as opposed to the injury that would be expected for being proximate a claymore. Wherein the device is angled to be directional, such a device generally distributes its vessels in a region that does not include the device, thereby enhancing the safety of the operator thereof.

Further, such a device is generally a one-shot disposable system that is preloaded and preconfigured for use, thus simplifying and reducing costs of operation thereof and the logistics required for its use. This also permits such a device to be used proximate a claymore mine, as injury to the device is not problematic. Generally, where such are used together, they will be controlled using electronics, computing devices, circuitry, or etc. that generally causes the payload delivery device to fire before the claymore so that the claymore does not disrupt the "aim" of the device. Use with a claymore mine permits extended coverage of a region that is normally beyond the control of a claymore defense system. Still further, such a device is also generally small and portable.

Still yet further, such a device may be used in combat and non-combat roles by altering aspects of its design, including but not limited to coverage area, vessel payloads (lethal, non-lethal, etc.) and etc.

In operation of one non-limiting example such a device is detonated or fired within a few feet of the operator where the projected vessels are fired in a forward direction away from the operator for an approximate distance of 40 meters, plus scattering additional vessels in a rectangular or other predetermined pattern with the maximum distance depending on the device configuration, including but not limited to the angle and orientation of each of the guides, the propellant charge in each of the guides, and the flight characteristics (weight, shape, etc.) of each of the vessels. The explosive aerial vessel projecting charge would generally be small and the launching case or container of the launch container would likely not be destroyed and could be safely positioned close to the controlling individual.

In operation of another non-limiting example, such a device would generally be placed approximately 50 to a 100 meters in front of or adjacent to the defensive positions in any zone poorly covered by other weapons systems. This variant is generally detonated by wire and clacker similar to the M18claymore. However, this exemplary system/device fires and disperses multiple explosive vessels vertically in the air like a fountain with a circular or other pre-determined distribution pattern about the device. The aerial vessels would generally be designed to explode about 4 to 5 meters above the ground. The explosive vessel projecting charge will be small but because the system is distant from the firing position a secondary charge disposed within the launching platform or adjacent thereto may be included and may be used to detonate the case of the launcher creating a secondary destructive event.

Figure 2:
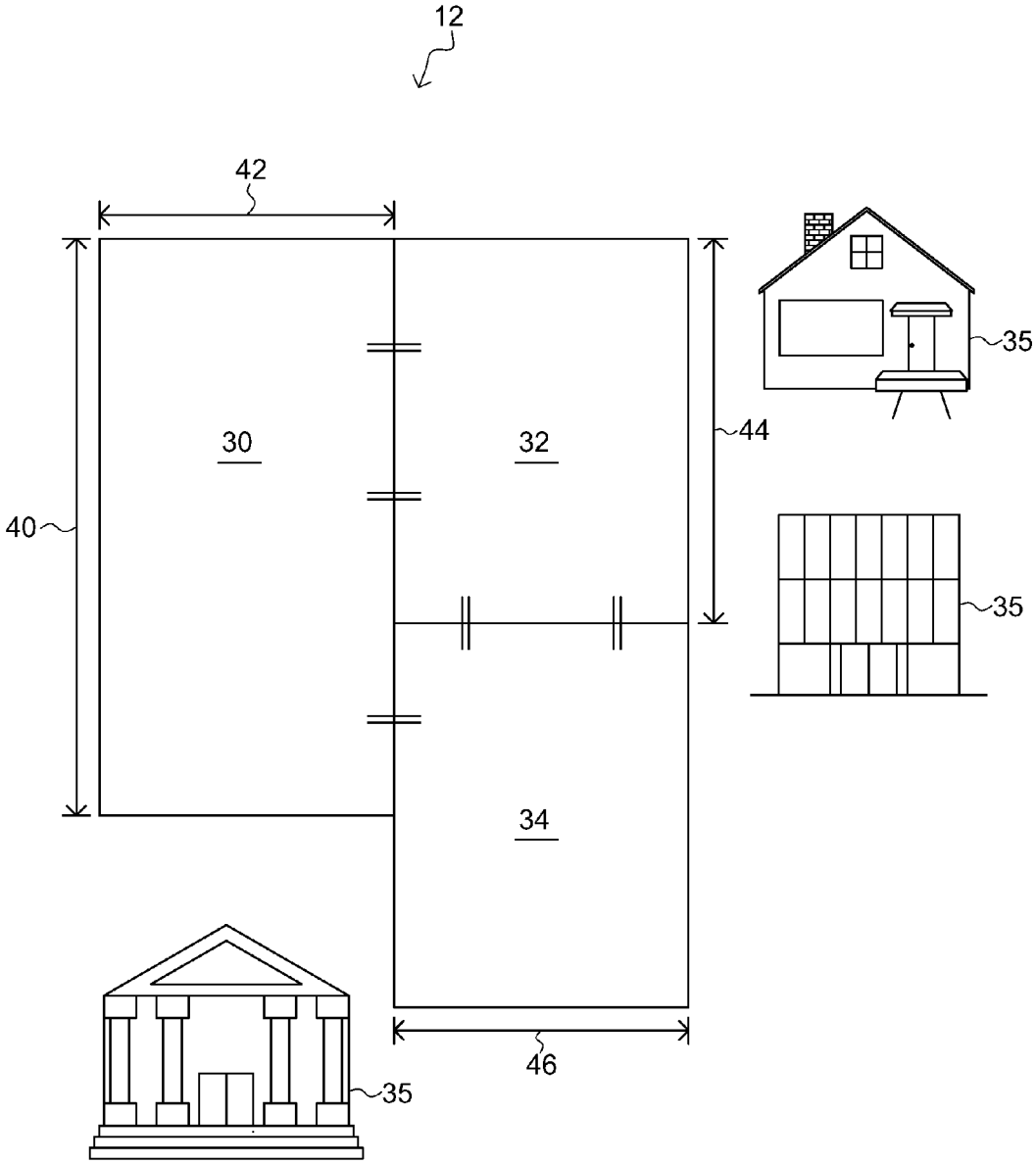
FIG. 2 is a top plan view of a defined area targeted by a payload delivery system including a plurality of coupled payload delivery devices, according to one embodiment of the invention.

FIG. 2 is a top plan view of a defined area targeted by a payload delivery system including a plurality of coupled payload delivery devices, according to one embodiment of the invention. There is shown a defined area 12 including a first section 30, a second section 32, and a third section 34 targeted by a payload delivery system.

The illustrated defined area 12 is targeted by a payload delivery system including a plurality of payload delivery devices. The associated plurality of payload delivery devices are configured to selectably couple together and launch a plurality of vessels over the defined area 12. Such coupling may be communicative coupling, such that triggering one triggers the rest and/or structural coupling such that the devices are coupled together at the base of each device. Devices that are or are not structurally coupled may be placed a set distance from each other and/or aimed to provide a predetermined coverage area. The defined area 12 may be surrounded by a plurality of buildings or structures 35. The illustrated payload delivery system coverage region is configured to launch a plurality of vessels, such as mortars or explosives, to disperse and explode over the defined area 12 and not explode or destroy the plurality of buildings or structures 35. In the illustrated example, the predefined area covers the streets and open space between the buildings, but not the buildings themselves. It also advantageously includes a region 30 that is not fully in sight of the likely launch position for such a deployment wherein the coverage rectangles are aligned with the launching position. Such a coverage (over and behind a building) is generally not possible with direct fire area dispersal systems, such as but not limited to the claymore system.

A non-limiting exemplary payload delivery system that covers the illustrated area may include a plurality of payload delivery devices that have varied dispersion characteristics and such characteristics may be noted/identified/labeled on each device. As a non-limiting example, a device set to cover region 30 may produce dispersion of vessels over a region that is a predetermined distance from the device and that has a right boundary that coincides with the right boundary of the launch platform of the device. Accordingly, the device launches to cover a rectangular area that is forward and to the left, but does not disperse any vessels to the forward right region of the device. Coverage of region 32 may be by a pair of similar devices, each with a coverage region mirrored to that of the device associated with region 30 but not as long.

The device covering region 34 may be placed a distance back from the two devices covering regions 30 and 32, which devices may actually be coupled together at their respective launching platforms.

The defined area 12 includes a first section 30 targeted by a first payload delivery device of a payload delivery system. The first payload delivery device includes a two dimensional array of launching guides configured to launch a plurality of vessels and disperse over the first section 30. The array of launching guides is configured to launch and disperse a plurality of vessels to cover a length 40 and a width 42 of the first section 30.

The first payload delivery device is configured to be selectably coupled to a second payload delivery device and a third payload delivery device. The second payload delivery device is configured to launch and disperse a plurality of vessels over a second section 32 and the third delivery device is configured to launch and disperse a plurality of vessels over a third section 34. The second payload delivery device and the third payload delivery device are configured to launch and disperse a plurality of vessels designed to each cover the second section 32 and the third section 34. The second section 32 and the third section 34 each include a defined length 44 and a defined width 46.

The first, the second, and the third payload delivery devices are configured to selectably couple together to form a payload delivery system configured to provide a projectile dispersion over a defined area 12. The first, the second, and the third payload delivery devices are positionally coupled together corresponding to projectile dispersion desired over the defined area 12. The first payload delivery device is positioned to the left of the second payload delivery device and the third payload delivery device is positioned behind the second payload delivery device, thereby forming the same configuration as the desired defined area 12.

Figure 3:
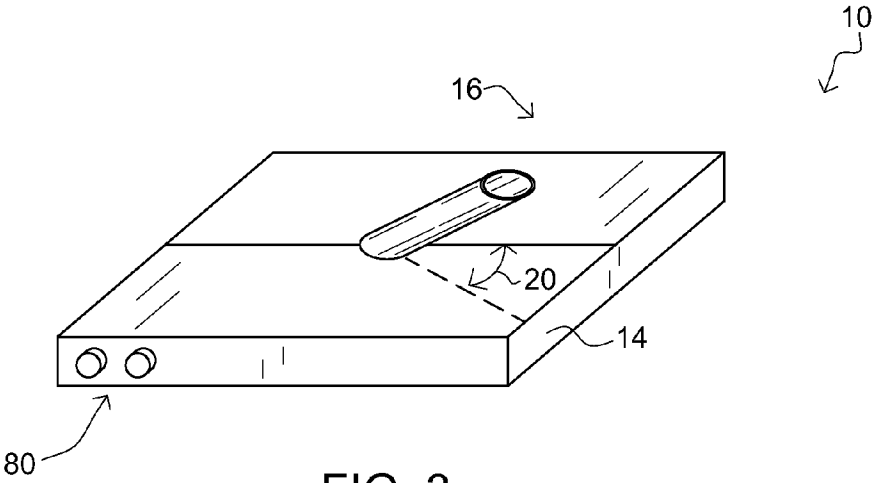
FIG. 3 is a perspective view of a launching guide of a payload delivery device, according to one embodiment of the invention.
Figure 4:
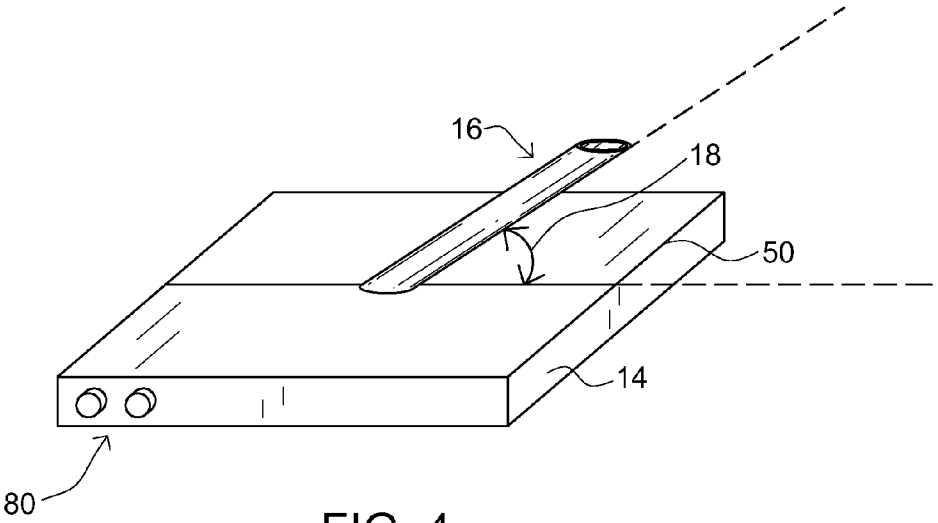
FIG. 4 is a perspective view of a launching guide of a payload delivery device, according to one embodiment of the invention.

FIGS. 3 and 4 illustrate perspective views of a launching guide of a payload delivery device, according to one embodiment of the invention. There is shown a payload delivery device 10 including a launching platform 14 having an angle adjustment mechanism 80 and a launching guide 16. The illustration is to clarify what is intended by the terms "inclination angle" and "horizontal direction angle." In particular, inclination angle is the angle above the horizontal plane while horizontal direction angle is the angle from a specified horizontal direction (generally straight forward, or in the direction of intended deployment). The range of each of the inclination angle and the horizontal direction angle is generally orthogonal, one to the other. Accordingly, wherein an inclination angle and a horizontal direction angle are both specified, the exact orientation (but, not location) of an elongated object may be uniquely determined in three-dimensional space.

The illustrated payload delivery device 10 is configured for projectile dispersion over a defined area. The payload delivery device 10 includes a launching platform 14 configured to provide structural support during projectile dispersion. The device 10 may also include a two-dimensional array of launching guides 16 extending upwardly from the launching platform 14. The illustrated launching guide 16 of the array is fixed at a specific inclination angle 18 and at a specific horizontal direction angle 20. The launching guide 16 of the array is fixed at a combination of the inclination angle 18 and the horizontal direction angle 20 that may be unique among the launching guides of the array (not shown). Accordingly, such a launching guide would be pointed in a direction that is unique among the group of launching guides (not shown).

The inclination angle 20 of the illustrated launching guide 16 is a measurement of an angular distance of the launching guide 16 from the plane 50 of the launching platform 14 (and/or from the plane of the horizon and/or plane of the ground or launching surface). The horizontal direction angle 18 of the launching guide 16 is a measurement of a distance of the launching guide from an arbitrarily selected cardinal direction (forward, backwards, left, right, north, south, etc.). In the illustrated example, the cardinal direction (cardinal zero) is forward. The inclination angle 18 and the horizontal direction angle 20 of the launching guide 16 is predetermined, in conjunction with the charge and flight characteristics of each vessel, to generate a substantially even distribution of projectile dispersion over a predetermined shape area. Such a predetermined shape area may be a square, rectangle, diamond, circle, oval, ellipsoid, irregular, L-Shaped, T-Shaped, or other desired shape. Wherein urban deployment is expected, square, rectangle, L-shaped and T-shaped deployments are the most likely to be useful.

When calculating inclination and horizontal direction angles, one will generally utilize ballistics equations, such as but not limited to vector equations, range equations, trajectory equations and the like, such as but not limited to equations converting charge energy (generally proportional to charge mass) to initial projectile velocity, mapping initial projectile velocity and angle to trajectory range (range is proportional to the square of the initial velocity times the sin function applied to double the inclination angle) along with factors intended to modify the expected range based on expected air resistance. This is generally solved by solving a combination of differential equations associated with the motion of the projectile including the force effects of air resistance, which is generally proportional to the square of the velocity. As the velocity of the projectile changes over the course of the trajectory, the air resistance also changes. The equations are often solved by iterative numerical methods intended to find the distance (usually x) traveled when the vertical position (usually y) returns to 0 as a function of initial launch angle (inclination angle), frictional characteristics of the projectile, and initial velocity of the projectile.

Wherein a particular shaped distribution is desired, these calculations may be made for each of the desired impact points and launch guides may be set to specific angle combinations that result in the desired distribution. The above calculations are helpful for determining a distance traveled for each projectile/guide pair and the horizontal direction angle then finally determines the placement in the overall pattern of the array of guides. Generally, from front to back (front being the direction of intended distribution of the vessels after launch), guides will have ever increasing or ever decreasing angles from rank to rank (front to back) of guides and will generally be proportional to rank number, rank number squared, or the like or combinations thereof. Generally, from side to side (horizontal directions generally orthogonal to the front and back), guides will have ever increasing or ever decreasing angles from rank to rank (side to side) of guides and such angles will generally be proportional to rank number, rank number squared or combinations thereof. Thus, even wherein each rank (front to back) has identical inclination angles and each orthogonal rank (side to side) has substantially identical horizontal direction (cardinal) angles, the combination of inclination and horizontal direction angles for each guide will generally be unique.

The illustrated launching platform 14 includes an angle adjustment mechanism 80 coupled to the launching platform 14 and in communication with a launching guide 16 of a two dimensional array of launching guides of a payload delivery system. The angle adjustment mechanism 80 is configured to adjust a horizontal direction angle and an inclination angle of the launching guide of the two dimensional array of launching guides. The angle adjustment mechanism 80 is configured to adjust a horizontal direction angle and/or an inclination angle, in predefined increments, of the launching guide 16.

Figure 5:
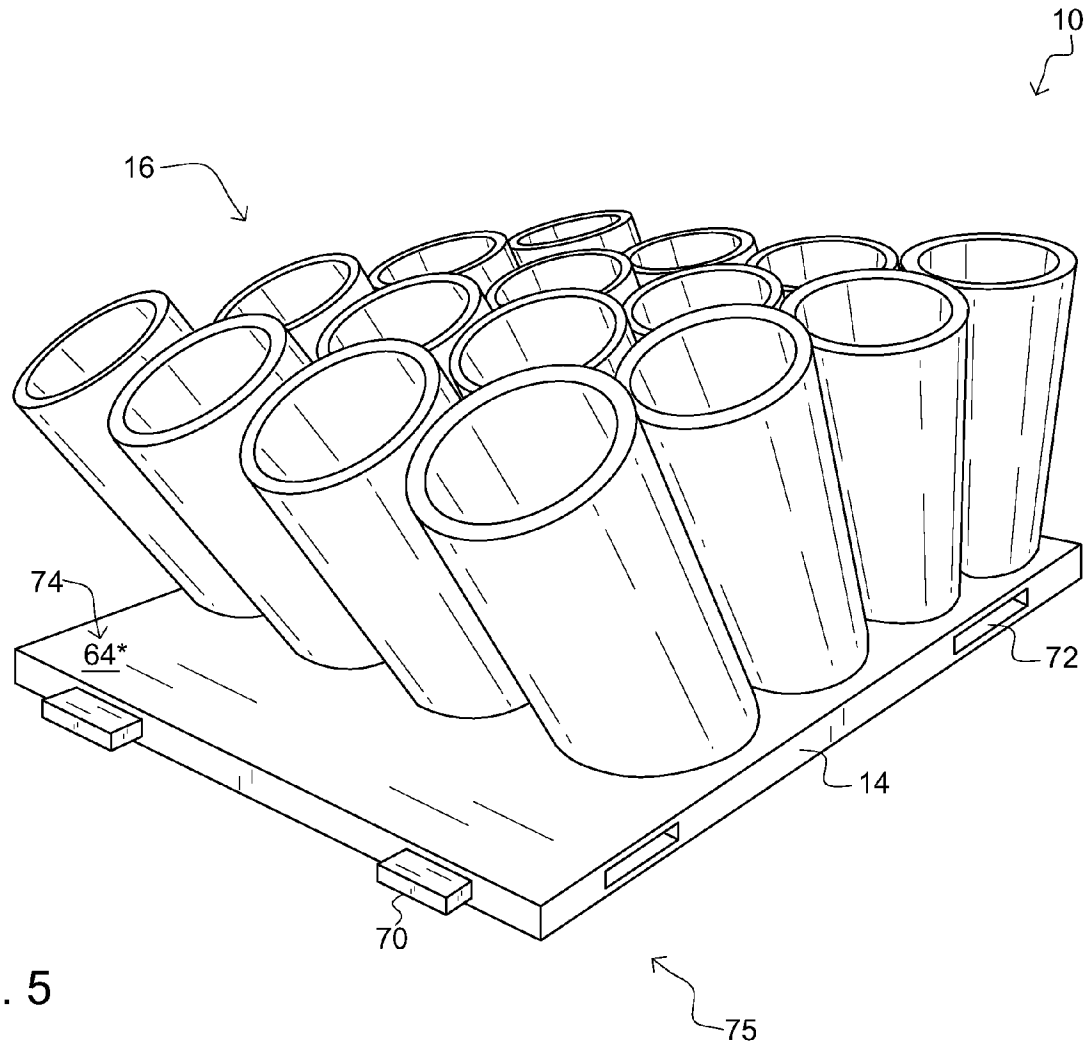
FIG. 5 illustrates a front perspective view of a payload delivery device, according to one embodiment of the invention.
Figure 6:
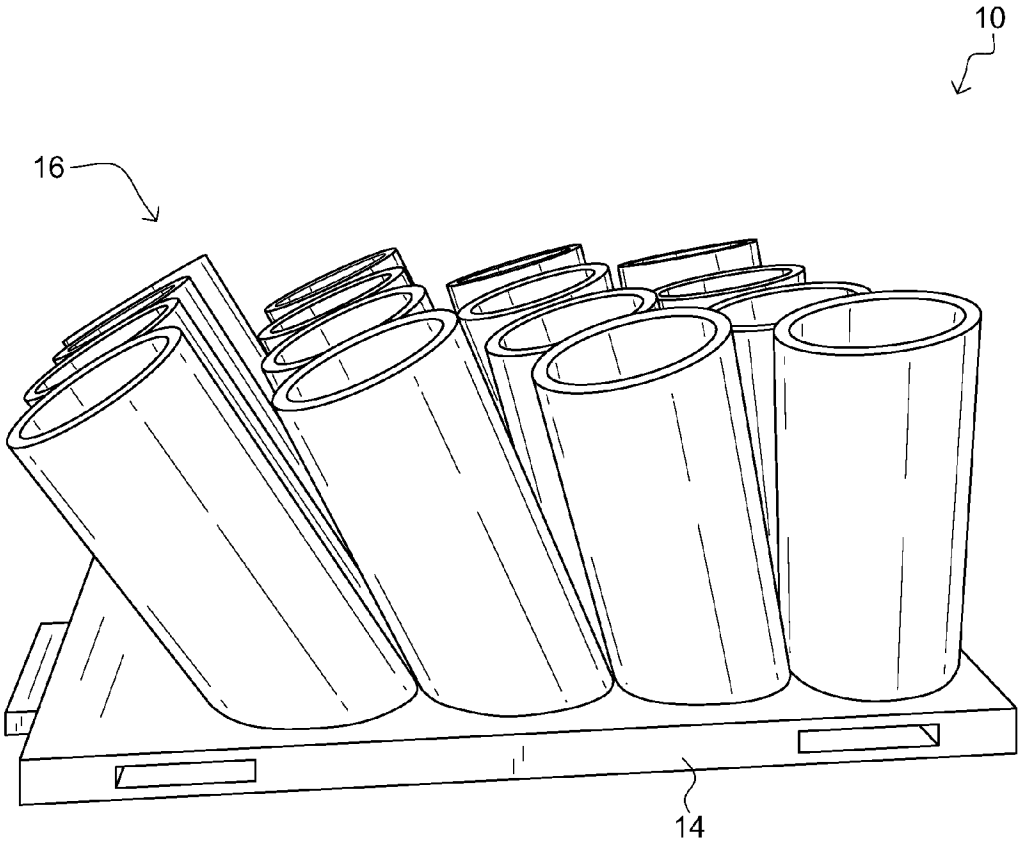
FIG. 6 is a side perspective view of a payload delivery device, according to one embodiment of the invention.
Figure 7:
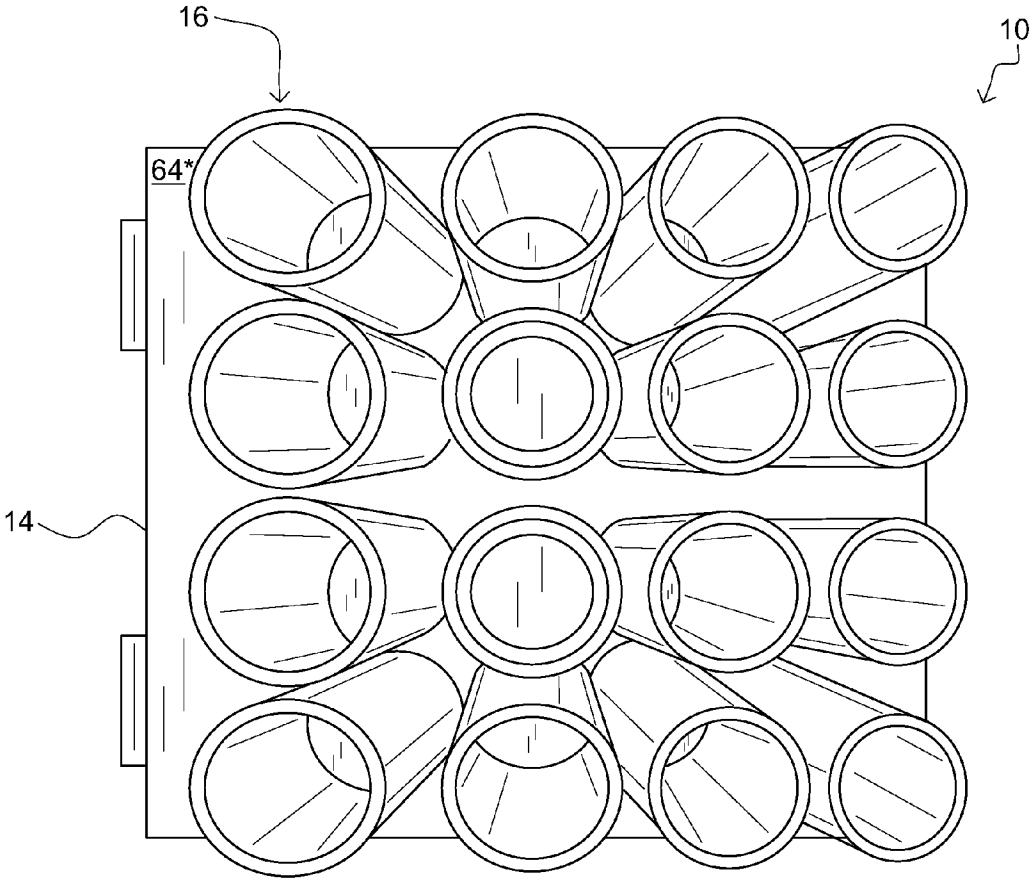
FIG. 7 is a top plan view of a payload delivery device, according to one embodiment of the invention.

FIGS. 5-7 illustrate a plurality of perspective views of a payload delivery device, according to one embodiment of the invention. There is shown a payload delivery device 10 including a launching platform 14 and a two dimensional array of launching guides 16 having four ranks of guides (front to back) and four ranks of guides (side to side), thereby including sixteen launch guides.

The illustrated payload delivery device 10 configured for projectile dispersion over a defined area. The payload delivery device 10 includes a launching platform 14 configured to provide structural support during use. The launching platform 14 is generally a rigid planar member that couples the array of launch guides in fixed positions and orientations relative to each other and that provides a surface for contact with the ground (or other launch position). The illustrated launching/launch platform also includes coupling devices configured to couple the launch platform to other launch platforms such that they may be connected together physically and/or be in communication with each other. The illustrated coupling devices may also include electrical or other connections such that launch signals propagated through one launching platform may be simultaneously propagated through all associated platforms. Coupling devices may include but are not limited to latches, snaps, buckles, tongue-and-groove fittings, puzzle piece fittings, post and hole fittings (illustrated), locking mechanisms, and the like and combinations thereof.

Launching platforms may also include one or more cavities therein that may include explosives wherein it is desired to detonate the entire platform after launch. Generally such explosives within the cavities would also be in delayed communication (electrical or otherwise) with the launching trigger system of the launching guides.

The illustrated device 10 also includes a two-dimensional array of launching guides 16 extending upwardly from the launching platform 14. Each launching guide of the array 16 is fixed at a combination of an inclination angle and a horizontal direction angle that is unique among the launching guides of the array. The device 10 is configured to launch and disperse a plurality of vessels that are functionally connected to the array of launching guides 16. Launch guides are generally elongated structures configured to give an initial trajectory to launched vessels. Such guides may be tubes having vessels stowed therein, may be rails upon which vessels travel during launch, combinations thereof and the like such that the guides provide sufficient structure for the vessels to impart a predefined initial launch orientation during launch. The illustrated launching guides have substantially similar inclination angles rank to rank (front to back) and substantially similar horizontal direction angles rank to rank (side to side).

Wherein generally rectangular deployment shapes are desired:

Inclination angle may be set as a function of distance from the front of the device and distance may be measured directly or may be measured discretely (such as but not limited to by rank number). Horizontal direction angle may be set as a function of distance from the side (or center, or other predefined side to side location) of the device and distance may be measured directly or may be measured discretely (such as but not limited to by rank number).

Wherein other deployment shapes are desired, angles may be determined as a function of position (actual or discrete, ie. rank) or may have to be solved for each guide depending on the complexity of the desired shape. Wherein a complex shape (T, L, etc.) is desired, angles may be functions of position, with step-like correction factors applying to particular ranges of ranks and/or arrays may be non-rectangular.

As illustrated in FIGS. 5 and 7, the launching platform 14 includes a symbolic indicator 74 associated with an operational characteristic of the device 10. The symbolic indicator 74 includes an operational characteristic selected from the group of operational characteristics consisting of: range, shape area, density, depth, width, length, and diameter. The symbolic indicator may include letters, colors, numbers, signs, symbols, diagrams, charts, etc. configured to describe or represent an operational characteristic of the payload delivery device 10. As a non-limiting example, there may be a set of payload delivery devices that may be color-coded such that the expected area of effect may be indicated by color, such as but not limited to blue=square, red=L-shaped, green=rectangle, and etc.

The launching platform 14 includes a mating structure 75 that is configured to mate to another similar launching platform. The mating structure 75 includes a protruding member 70 and a receiving member 72 configured to selectably couple to other protruding and receiving members of other launching platforms of payload delivery devices. The protruding member 72 is sized and shaped to selectably couple to the receiving member 74. The receiving member 74 is sized and shaped to receive the protruding member, thereby coupling multiple launching platforms together to form a payload delivery system.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the illustrations and description generally relate to use of the device/system on the ground, such a device may be used from water-based (ship, boat, dock, bridge, etc.) platforms for the defense thereof, and/or from aerial platforms (helicopter, airplane, balloon, drone, etc.).

Additionally, although the figures illustrate a particular array of launching guides, it is understood that the variations on the number of guides and their exact orientations are plethoric except where otherwise specifically limited.

It is also envisioned that the system/device(s) described herein may be used offensively, defensively, for protection of the peace, dispersing crowds, commercially, for distribution of prizes, toys, candy, etc. to a crowd, lethally, non-lethally, and/or for rapid deployment of cargo of any desired type over a predetermined area, and the like.

It is expected that there could be numerous variations of the design of this invention. An example is that the launching platform may be a square, rectangle, circle, oval, irregularly shaped, and etc. and combinations thereof. Another example is that the launching platform and/or launch guides may include a variety of indicia and/or decorative features.

Finally, it is envisioned that the components of the device may be constructed of a variety of materials, including but not limited to metals, ceramics, rubbers, plastics, fibers, composites, wood, minerals, and the like and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A payload delivery device for projectile dispersion over a defined area, comprising:

a) a launching platform configured to provide structural support and including a secondary charge configured to detonate the launching platform;

b) a two-dimensional array of launching guides extending upwardly from the launching platform, wherein each launching guide of the array is fixed at a specific inclination angle and at a specific horizontal direction angle and wherein each launching guide of the array is fixed at a combination of inclination angle and horizontal direction angle that is unique among the launching guides of the array; and c) a plurality of vessels functionally connected to the array of launching guides and configured to launch therefrom.

2. The device of claim 1, wherein the horizontal direction angle of each of the launching guides is a function of a distance of the launching guide from an edge of the launching platform.

3. The device of claim 1, wherein the inclination angle of each of the launching guides is a function of a distance of the launching guide from an edge of the launching platform.

4. The device of claim 1, wherein the inclination angle and the horizontal direction angle of each of the launching guides is predetermined to generate a substantially even distribution of projectile dispersion over a predetermined shape area.

5. The device of claim 1, further comprising an angle adjustment mechanism coupled to the launching platform and in communication with the two dimensional array of launching guides, configured to adjust a horizontal direction angle and an inclination angle of the two dimensional array of launching guides, in predefined increments.

6. The device of claim 1, wherein the launching platform includes a mating structure configured to mate to another similar launching platform.

7. The device of claim 1, wherein the plurality of vessels include a payload selected from the group of payloads consisting of: explosives, smoke generation agents, and irritant (chemical) agents.

8. A payload delivery system for projectile dispersion over a defined area, comprising:

a) a launching platform configured to provide structural support;

b) a two-dimensional array of separate and distinct launching guides having open space therebetween and extending upwardly from the launching platform, wherein each launching guide of the array is fixed at a specific inclination angle and at a specific horizontal direction angle and each launching guide of the array is fixed at a unique combination of inclination angle and horizontal direction angle; and c) a plurality of vessels functionally connected to the array of launching guides and configured to launch therefrom; wherein the horizontal direction angle of each of the launching guides is a function of a distance of the launching guide from an edge of the launching platform and the inclination angle of each of the launching guides is a function of a distance of the launching guide from an edge of the launching platform, and wherein the launching platform includes a secondary charge configured to detonate the launching platform.

9. The system of claim 8, wherein the inclination angle and the horizontal direction angle of each of the launching guides is predetermined to generate a substantially even distribution of projectile dispersion over a predetermined shape area.

10. The system of claim 9, wherein the launching platform includes a symbolic indicator associated with an operational characteristic of the system; wherein the symbolic indicator includes an operational characteristic selected from the group of operational characteristics consisting of: range, shape area, density, depth, width, length, and diameter.

11. The system of claim 10, further comprising an angle adjustment mechanism coupled to the launching platform and in communication with the two dimensional array of launching guides, configured to adjust a horizontal direction angle and an inclination angle of the two dimensional array of launching guides, in predefined increments.

12. The system of claim 11, wherein the launching platform includes a mating structure configured to mate to another similar launching platform.

13. The system of claim 12, wherein the plurality of vessels include a payload selected from the group of payloads consisting of: explosives, smoke agents, and irritant (chemical) agents.

14. A payload delivery system for projectile dispersion over a defined area, comprising:

a) a launching platform configured to provide structural support and including a secondary charge configured to detonate the launching platform; wherein the launching platform includes a symbolic indicator associated with an operational characteristic of the system; wherein the launching platform includes a mating structure configured to mate to another similar launching platform;

b) a two-dimensional array of launching guides extending upwardly from the launching platform, wherein each launching guide of the array is fixed at a specific inclination angle and at a specific horizontal direction angle and each launching guide of the array is fixed at a unique combination of inclination angle and horizontal direction angle; wherein the horizontal direction angle of each of the launching guides is a function of a distance of the launching guide from an edge of the launching platform; wherein the inclination angle of each of the launching guides is a function of a distance of the launching guide from an edge of the launching platform; wherein the inclination angle and the horizontal direction angle of each of the launching guides is predetermined to generate a substantially even distribution of projectile dispersion over a predetermined shape area;

c) a plurality of vessels functionally connected to the array of launching guides and configured to launch therefrom; and d) an angle adjustment mechanism coupled to the launching platform and in communication with the two dimensional array of launching guides, configured to adjust a horizontal direction angle and an inclination angle of the two dimensional array of launching guides, in predefined increments.

15. The system of claim 14, wherein the plurality of vessels include a payload selected from the group of payloads consisting of: explosives, smoke generation agents, and irritant (chemical) agents.

16. The system of claim 14, wherein the predetermined shape area is a rectangle and wherein the system further includes a claymore mine adjacent to and functionally coupled to the launching platform such that the claymore is detonated in coordination with launching of the plurality of vessels by the launching platform.

* * * * *